US011721471B2

(12) United States Patent
Voss et al.

(10) Patent No.: US 11,721,471 B2
(45) Date of Patent: Aug. 8, 2023

(54) ELECTRIC DEVICE WITH PRESSING PLATES FOR CLAMPING A MAGNETIZABLE CORE

(71) Applicant: Siemens Energy Global GmbH & Co. KG, Munich (DE)

(72) Inventors: Stephan Voss, Neunkirchen am Brand (DE); Joerg Froehner, Gevelsberg (DE); Jonas Claus, Wetter (DE); Julian Kraus, Roettenbach (DE); Markus Baumann, Fuerth (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 451 days.

(21) Appl. No.: 16/966,551

(22) PCT Filed: Jan. 4, 2019

(86) PCT No.: PCT/EP2019/050144
§ 371 (c)(1),
(2) Date: Jul. 31, 2020

(87) PCT Pub. No.: WO2019/149469
PCT Pub. Date: Aug. 8, 2019

(65) Prior Publication Data

US 2021/0050139 A1 Feb. 18, 2021

(30) Foreign Application Priority Data

Jan. 31, 2018 (DE) ..... 10 2018 201 488.4

(51) Int. Cl.
*H01F 27/12* (2006.01)
*H01F 27/245* (2006.01)
*H01F 27/28* (2006.01)

(52) U.S. Cl.
CPC ..... *H01F 27/12* (2013.01); *H01F 27/245* (2013.01); *H01F 27/28* (2013.01)

(58) Field of Classification Search
CPC ..... H01F 27/12; H01F 27/245; H01F 27/28; H01F 27/263; H01F 27/321; H01F 27/06; H01F 27/02; H01F 27/266
See application file for complete search history.

(56) References Cited

U.S. PATENT DOCUMENTS 4,983,859 A 1/1991 Nakajima et al.
6,494,617 B1 12/2002 Stokes et al.
(Continued)

FOREIGN PATENT DOCUMENTS

AT 275669 B 11/1969
CN 1623212 A 6/2005
(Continued)

OTHER PUBLICATIONS

Hiroshi Hata et al: "Development of A Superconducting Transformer for Rolling Stock", Quarterly Report of RTRI, vol. 47, No. 1, pp. 24-27, XP055575746, JP; ISSN: 0033-9008, DOI: 10.2219/rtriqr.47.24; the whole document; 2006:.
(Continued)

*Primary Examiner* — Tuyen T Nguyen
(74) *Attorney, Agent, or Firm* — Laurence A. Greenberg; Werner H. Stemer; Ralph E. Locher

(57) ABSTRACT

An electric device, for example a track transformer, connects to a high-voltage line. The electric device has a magnetizable core, at least one winding which is arranged in the vicinity of the core, and a housing which is filled with an insulating fluid and in which at least one winding is arranged. The core is arranged at least partly outside of the housing. In order to allow a stable mounting of a core formed of two halves, the core is arranged completely
(Continued)

between two opposing pressing plates, between which tension elements for clamping the core extend.

11 Claims, 1 Drawing Sheet

(56) References Cited

U.S. PATENT DOCUMENTS

| | | | |
|---|---|---|---|
| 10,629,352 | B2 | 4/2020 | Stefanutti et al. |
| 2005/0104707 | A1 | 5/2005 | Rothmayer et al. |
| 2010/0211205 | A1 | 8/2010 | Baumann et al. |
| 2011/0309902 | A1 | 12/2011 | Bonin et al. |
| 2012/0056706 | A1 | 3/2012 | Schaefer et al. |
| 2012/0294037 | A1 | 11/2012 | Holman et al. |
| 2015/0091605 | A1 | 4/2015 | Davis |
| 2015/0168635 | A1 | 6/2015 | Holman et al. |
| 2015/0332838 | A1 | 11/2015 | Blanke |
| 2016/0308300 | A1 | 10/2016 | Lewin et al. |

FOREIGN PATENT DOCUMENTS

| | | | | |
|---|---|---|---|---|
| CN | 101558460 | A | | 10/2009 |
| CN | 101754816 | A | | 6/2010 |
| CN | 102385973 | A | | 3/2012 |
| CN | 104838458 | A | | 8/2015 |
| CN | 105225794 | A | | 1/2016 |
| CN | 204991387 | U | | 1/2016 |
| CN | 105378233 | A | | 3/2016 |
| CN | 105874654 | A | | 8/2016 |
| CN | 206040385 | U | | 3/2017 |
| DE | 1563243 | A1 | | 10/1969 |
| DE | 2423416 | A1 | | 11/1975 |
| DE | 3413359 | A1 | | 10/1985 |
| EP | 2929551 | B1 | | 5/2017 |
| JP | 04162605 | A | * | 6/1992 |
| JP | 2000200723 | A | | 7/2000 |
| JP | 4038957 | B2 | * | 1/2008 |
| JP | 2009117473 | A | | 5/2009 |
| RU | 2017112293 | A | | 10/2018 |
| WO | WO 0002211 | A1 | | 1/2000 |
| WO | WO-2014086948 | A2 | * | 6/2014 ..... H01F 27/08 |
| WO | WO 2016038222 | A1 | | 3/2016 |

OTHER PUBLICATIONS

Hata H. et al.: "Developement of Superconducting Transformer for Railway Traction", Quarterly Report of RTRI, vol. 47, No. 1, Jan. 1, 2006 (Jan. 1, 2006), pp. 24-27, XP055575746, JP ISSN:0033-9008.

Hou Jia et al.: "Loosely Coupled Transformer with Mixed Winding and Electromagnetic Shielding", Automation of Electric Power Systems, vol. 40, No. 18, Sep. 25, 2016, pp. 91-96—English abstract on p. 96.

* cited by examiner

ELECTRIC DEVICE WITH PRESSING PLATES FOR CLAMPING A MAGNETIZABLE CORE

BACKGROUND OF THE INVENTION

Field of the Invention:

The invention relates to an electric device for connection to a high-voltage line, comprising a magnetizable core, at least one winding which is arranged in the vicinity of the core, and a housing which is filled with insulating fluid and in which at least one winding is arranged, wherein the core is arranged at least partly outside the housing.

An electric device of this kind is already known from WO 2016/038222 A1. Said document discloses a transformer which has an air-cooled iron core with core limbs which each extend through a fluid-tight housing. The two core limbs are connected to one another by an upper yoke and a lower yoke so as to form a closed magnetic circuit. The windings of the transformer are arranged in pairs in the two housings which are situated next to one another and are filled with an insulating fluid. Two clamping frames are provided in order to clamp the windings to the core, said clamping frames each consisting of two pressing supports which are situated opposite one another. The two pressing supports extend laterally next to the upper and, respectively, lower yoke, wherein the clamping frame is fixedly held on the core by transverse clamping of the pressing supports and, at the same time, the electrical sheets of the core which bear flat against one another are clamped to one another. Furthermore, the windings are held in a stable manner on the respective core limb by means of the pressing frame which is assembled in this way.

EP 2 929 551 B1 likewise discloses a transformer comprising an air-cooled core and windings which are encapsulated limb by limb.

The electric device mentioned at the outset has the disadvantage that cores which consist of two halves cannot be used with the holding arrangement presented there.

SUMMARY OF THE INVENTION

The object of the invention is therefore to provide an electric device of the kind mentioned at the outset with which a core which consists of two halves can also be held in a stable manner.

The invention achieves this object in that the core is arranged completely between two pressing plates which are situated opposite one another and between which tension elements for clamping the core extend.

According to the invention, the core is arranged between two pressing plates which are situated opposite one another overall. In other words, the entire core together with all of its sections extends between the pressing plates. The pressing force which is introduced into the core by means of the pressing plates is oriented parallel to the longitudinal direction of the windings and the core sections which extend through the windings. In this way, it is also possible to fix cores which consist of a plurality of parts. The core parts, for example core halves, which are clamped to one another can either touch or, if required, be held at a distance from one another at the outer contours thereof in this case, so that an air gap is delimited between them. The pressing plates which are connected to one another by means of the tension elements provide a stable holding frame which is suitable for fixing the core, housing and windings in a cost-effective manner. Pressing plates and tension elements can consist of any desired materials in principle. However, pressing plates and tension elements advantageously consist of an electrically non-conductive material, for example a fiber-reinforced plastic.

On account of the holding concept according to the invention, further assembly components for holding the electric device can be dispensed with. This provides an effective and compact electric device which can be quickly and easily assembled.

According to a preferred variant of the invention, the core has core limbs which are connected to one another by means of a lower yoke and an upper yoke, wherein the upper yoke bears at the end side against an upper pressing plate and the lower yoke bears at the end side against a lower pressing plate. In this way, the core forms a closed magnetic circuit which has been found to be particularly expedient. The core limbs extend in a longitudinal direction which is oriented parallel to the pressing force.

Within the scope of the invention, the core is embodied, for example, as a cut strip-wound core which is usually fixed with the aid of bandages or clips. In this case, the bandage is placed along the periphery around the cut strip-wound core and mechanically fixed there. Bandage clasps are used for fixing purposes. The required mechanical holding forces for the wound core are generated by the clamping tension of the bandage. In a departure from this, clips with spring properties which press the core halves of the cut strip-wound cores against one another are used according to the prior art. Conductive metal elements in which eddy currents are induced during operation of the electric device, which eddy currents cause losses and have a negative influence on the degree of efficiency of the electric device, are often used in this case.

In order to simplify assembly, it is advantageous within the scope of the invention when at least one pressing plate has a recess for receiving a section of a yoke of the core. The recess is advantageously designed with a complementary shape in relation to the region of the yoke which is received by the recess. This configuration with a complementary shape firstly renders possible a more compact configuration of the electric device according to the invention. Furthermore, assembly of the electric device is also simplified and stability is increased.

According to a variant of the invention, the electric device is a transformer, in particular a transformer of a rail vehicle. In a departure from this, the electric device is designed as an inductor.

According to a preferred variant of the invention, the core has two core limbs which are arranged parallel to one another, wherein each core limb is enclosed by at least two windings which are arranged concentrically in relation to one another. According to this advantageous further development, the electric device is embodied as a transformer. The core limb serves for inductive coupling of the winding which is arranged concentrically in relation to one another. The windings are preferably arranged in a fluid-tight housing which surrounds the respective core limb and is filled with a fluid, for example an ester or a mineral oil. The insulating fluid firstly provides the required electrical insulation but also cooling for the windings.

The housing preferably consists of an electrically non-conductive insulating material, for example a fiber-reinforced plastic or the like.

Each winding is advantageously arranged in a housing.

According to a further variant of the invention, at least one winding is arranged between two housing cover plates of the housing, wherein the housing cover plates are clamped to one another with the aid of the tension elements. In this way, the tension elements serve not only for clamping the core but rather the tension elements also allow each winding to be securely held in a defined position in relation to the core. To this end, the tension elements are mechanically connected to the housing cover plates between which said winding is arranged. At least two windings which are arranged concentrically in relation to one another bear against a housing cover plate on each end side. The housing cover plates are situated opposite one another, like the pressing plates, so that they can be clamped against one another by means of the tension elements. The winding pressure which is required for holding the winding on the core is introduced into the windings in this way.

The tension elements are advantageously threaded rods, cables, solid bars, pipes or networks of cables. Threaded rods onto which clamping nuts can be screwed are preferably used within the scope of the invention. In this case, the threaded rods extend through openings in sections of the pressing plates or housing cover plates, so that the required clamping or holding forces can be generated by tightening the screws.

According to a preferred variant of the invention, the tension elements are manufactured from an electrically non-conductive material. These include any desired fiber-reinforced plastics which have the required mechanical strength.

The pressing plate advantageously consists of one piece. However, within the scope of the invention, it is also possible for the pressing plate to consist of a plurality of parts. The same applies for the housing cover plates.

The core advantageously has two core halves which bear against one another or delimit an air gap with the aid of spacers. According to a further variant, the core is a winding strip core.

Further expedient refinements and advantages of the invention are the subject matter of the following description of exemplary embodiments of the invention with reference to the figures of the drawing, in which identical reference signs refer to identically acting components.

DETAILED DESCRIPTION OF THE INVENTION

Figure 1:
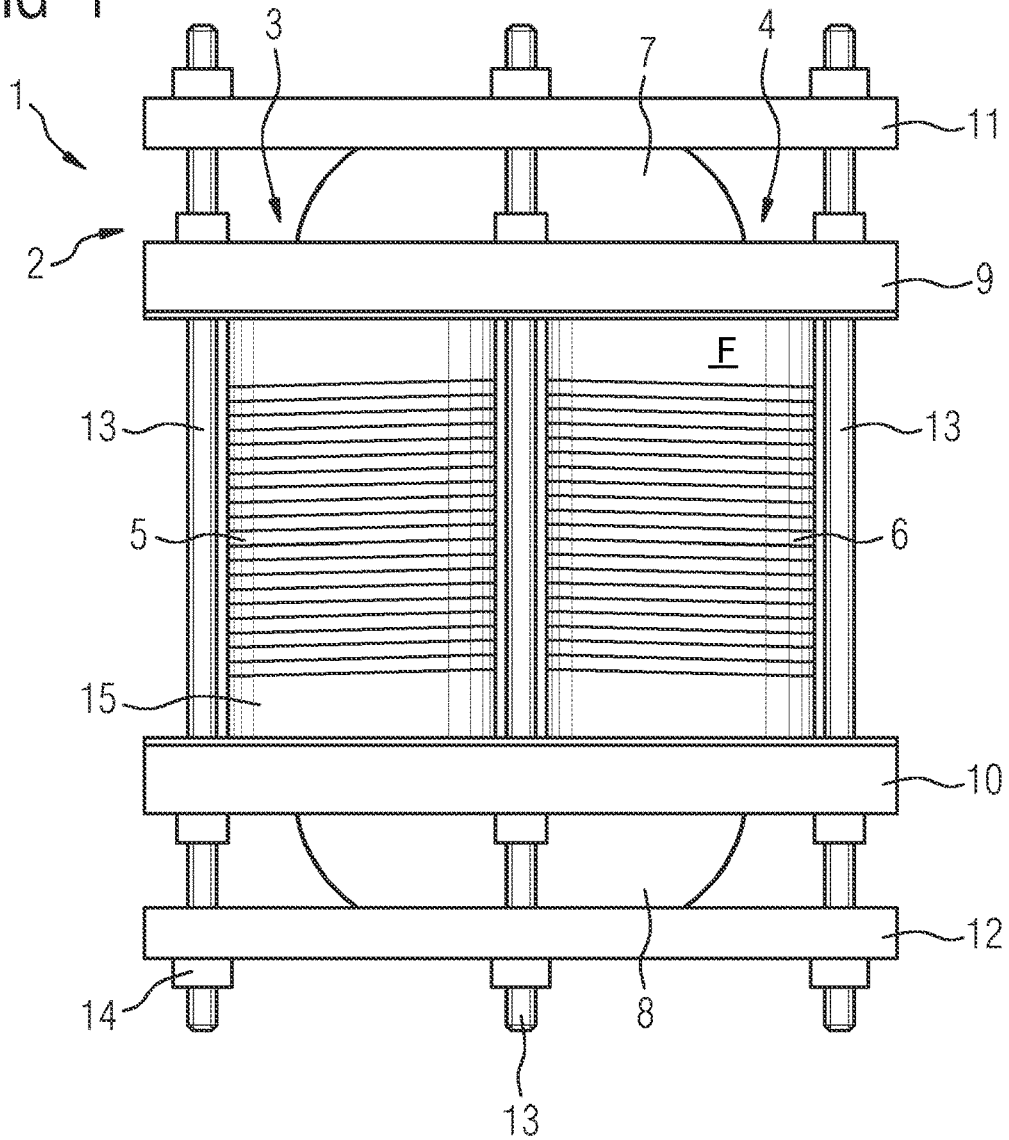
FIG. 1 shows a side view of an exemplary embodiment of the electric device according to the invention.

FIG. 1 shows a side view of an exemplary embodiment of the electric device 1 according to the invention. The electric device which is embodied as a transformer 1 has a core 2 with two core limbs 3 and 4 which each extend through one of two housings. In FIG. 1, the housings are illustrated without side walls in order to clear the view of the outer windings 5 and 6 which are arranged in the housing. The core limbs 3 and 4 are connected to one another by an upper yoke 7 and a lower yoke 8, so that a closed magnetic circuit is created. The core 2 consists of a magnetizable material, that is to say a ferromagnetic material for example, and is embodied as a so-called cut strip-wound core which has a plurality of winding or electrical strips which bear against one another. In this case, the electrical strips are, for example, grain-oriented electrical strips or electrical sheets. In a departure from this, said electrical strips consist of an amorphous material.

In each housing which is illustrated without a side wall and fully surrounds the core limbs 3 and 4, the high-voltage winding 5 or 6, which can be seen from the outside, and respectively a low-voltage winding, not illustrated in the figure, are arranged concentrically in relation to one another. The concentric windings are inductively coupled to one another by the core limbs 3 and 4. The housing is filled with an insulating fluid F which serves for electrically insulating the high-voltage winding 5 and the low-voltage winding but also for cooling said windings. The high-voltage winding 5 is connected in series with the high-voltage winding 6. The same applies for the low-voltage windings which are arranged within the high-voltage windings 5, 6. In addition to the side wall, not illustrated in the figures, which is of cylindrical design and runs around the windings, the housing consists of two end-side housing cover plates 9 and 10 which are connected to the side wall, not illustrated, in a fluid-tight manner.

The core 2 is arranged completely between a first pressing plate 11 and a second pressing plate 12 which are situated opposite one another and are connected to one another by tension elements 13. In the exemplary embodiment shown, the tension elements are embodied as threaded rods 13 which extend in a longitudinal direction and are provided with an external thread. Clamping nuts 14 which can be screwed onto the threaded rods 13 can then be screwed onto the respective threaded rod 13 until the core 2 which is situated between the pressing plates 11 and 12 is sufficiently fixedly clamped. Furthermore, the threaded rods 13 extend through passage holes which are provided in the housing cover plate 9 and the housing cover plate 10. Therefore, the housing cover plates 9 and 10 which are situated opposite one another can also be clamped to one another with the aid of further clamping nuts 14. In this case, the windings bear either directly or else by means of a winding ring 15 or another component against the housing cover plates 9 and 10, so that the required winding pressure is introduced into the windings owing to the clamping of the housing cover plates 9 and 10 in order to hold said windings in a stable manner in the desired position on the respective core limb 3, 4. Therefore, a holding frame is provided by the pressing plates 11, 12, the housing cover plates 9 and 10 and the tension elements 13.

The holding frame allows simple, cost-effective assembly of the electric device 1 according to the invention. Furthermore, it is possible to insert cores 2 which consist of two halves. The two halves of the core 2 can bear against one another, so that a closed magnetic circuit is formed. In a departure from this, non-magnetizable spacers are provided between the core halves, which non-magnetizable spacers define an air gap between the halves.

Figure 2:
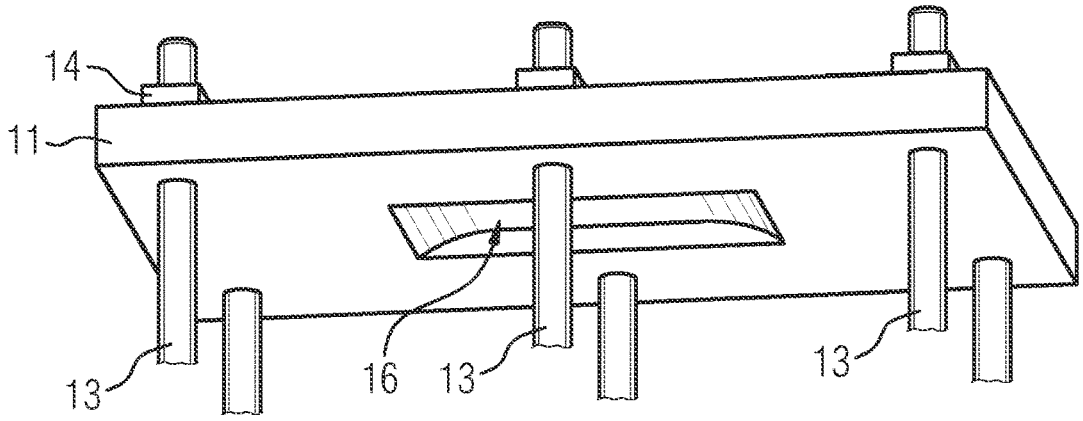
FIG. 2 shows a view of a detail of the mechanical frame of the electric device according to FIG. 1.

FIG. 2 shows a view of a detail of the upper first pressing plate 11. It can be seen that said pressing plate is connected to the lower pressing plate by means of a total of six threaded rods 13. In particular, it can be seen that the upper pressing plate 11 has a recess 16 which is configured with a complementary shape in relation to the outer contour of the upper yoke 7 in this region. The recess or indentation 16 simplifies assembly and increases the mechanical strength of the transformer 1.

The invention claimed is:

1. An electric device for connection to a high-voltage line, the electric device comprising:

a magnetizable core;

at least one winding disposed in a vicinity of said magnetizable core;

a housing filled with an insulating fluid and in which said at least one winding is disposed, wherein said magnetizable core is disposed at least partly outside said housing;

tension elements; and two pressing plates, said magnetizable core is disposed completely between said two pressing plates which are situated opposite one another and between which said tension elements for clamping said magnetizable core extend.

2. The electric device according to claim 1, wherein said magnetizable core has a lower yoke, an upper yoke and core limbs which are connected to one another by means of said lower yoke and said upper yoke, wherein said upper yoke is supported at an end side against an upper pressing plate of said two pressing plates and said lower yoke is supported at an end side against a lower pressing plate of said two pressing plates.

3. An electric device for connection to a high-voltage line, the electric device comprising:

a magnetizable core having a yoke; and at least one winding disposed in a vicinity of said magnetizable core;

a housing filled with an insulating fluid and in which said at least one winding is disposed, wherein said magnetizable core is disposed at least partly outside said housing;

tension elements; and two pressing plates, said magnetizable core is disposed completely between said two pressing plates which are situated opposite one another and between which said tension elements for clamping said magnetizable core extend, at least one of said two pressing plates having a recess formed therein for receiving said yoke of said magnetizable core.

4. The electric device according to claim 1, wherein:

said at least one winding is one of at least two windings; and said magnetizable core has two core limbs which are disposed parallel to one another, wherein each of said core limbs is enclosed by said at least two windings.

5. The electric device according to claim 4, wherein said at least one winding is disposed in said housing and is clamped by means of said tension elements.

6. The electric device according to claim 5, wherein:

said housing has two housing cover plates; and said at least one winding is disposed between said two housing cover plates of said housing, wherein said housing cover plates are clamped to one another by means of said tension elements.

7. The electric device according to claim 1, wherein said tension elements are threaded rods, cables, solid bars, pipes or networks of cables.

8. The electric device according to claim 1, wherein said tension elements and/or said two pressing plates are formed from an electrically non-conductive material.

9. The electric device according to claim 1, wherein at least one of said two pressing plates is formed from a plurality of parts.

10. The electric device according to claim 1, wherein said magnetizable core has two core halves which bear against one another or delimit an air gap with an aid of spacers.

11. The electric device according to claim 1, wherein said magnetizable core is a winding strip core.

* * * * *